US012428977B2

(12) United States Patent
Oriol et al.

(10) Patent No.: US 12,428,977 B2
(45) Date of Patent: Sep. 30, 2025

(54) AUXILIARY OIL TANK FOR AN AIRCRAFT TURBINE ENGINE

(71) Applicant: SAFRAN AIRCRAFT ENGINES, Paris (FR)

(72) Inventors: Sebastien Oriol, Moissy-Cramayel (FR); Mohammed-Lamine Boutaleb, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 18/694,588

(22) PCT Filed: Sep. 27, 2022

(86) PCT No.: PCT/FR2022/051809
§ 371 (c)(1),
(2) Date: Mar. 22, 2024

(87) PCT Pub. No.: WO2023/052717
PCT Pub. Date: Apr. 6, 2023

(65) Prior Publication Data

US 2024/0392695 A1 Nov. 28, 2024

(30) Foreign Application Priority Data

Sep. 30, 2021 (FR) ..... 2110348

(51) Int. Cl.
*F01D 25/18* (2006.01)
*F01D 17/16* (2006.01)

(52) U.S. Cl.
CPC ..... *F01D 25/18* (2013.01); *F01D 17/16* (2013.01)

(58) Field of Classification Search
CPC ..... F01D 25/18; F01D 25/20; F01D 17/16; F01D 7/00; F05D 2260/79; F05D 2260/98
See application file for complete search history.

(56) References Cited

U.S. PATENT DOCUMENTS 2,316,729 A * 4/1943 Tryon ..... F16N 19/00 251/126
2,888,097 A * 5/1959 Scheffler, Jr. ..... F16N 39/005 55/400

(Continued)

FOREIGN PATENT DOCUMENTS

EP 4296475 A1 * 12/2023 ..... F01D 25/18
EP 4296476 A1 * 12/2023 ..... F01D 25/18

(Continued)

OTHER PUBLICATIONS

International Search Report received for PCT Patent Application No. PCT/FR2022/051809, mailed on Dec. 21, 2022, 5 pages (2 pages of English Translation and 3 pages of Original Document).

*Primary Examiner* — Nathaniel E Wiehe
*Assistant Examiner* — Wayne A Lambert
(74) *Attorney, Agent, or Firm* — WOMBLE BOND DICKINSON (US) LLP

(57) ABSTRACT

An auxiliary oil tank including an enclosure that includes: a first internal volume (V1) in fluid communication with the first outlet port, a second internal volume (V2) in fluid communication with the second outlet port and separated from the first internal volume (V1) by a baffle, the baffle having a first end wall extending from the top wall towards the bottom wall and a second end wall extending from the bottom wall towards the top wall, the first and second end walls being substantially parallel, the first end wall and the (Continued)

lower wall delimiting a first fluid passage (P1), and the second end wall and the upper wall delimiting a second fluid passage (P2).

11 Claims, 7 Drawing Sheets

(56) References Cited

U.S. PATENT DOCUMENTS 2,983,331 A * 5/1961 Helsley, Jr. ..... F16N 39/002 96/187
3,722,624 A * 3/1973 Buckland ..... F01D 25/183 277/432
4,143,193 A * 3/1979 Rees ..... B29C 33/14 220/555
4,210,176 A * 7/1980 Emming ..... F15B 1/26 137/574
4,346,786 A * 8/1982 Midgley ..... F01M 11/067 184/6.4
4,856,273 A * 8/1989 Murray ..... F01D 25/18 384/473
5,333,704 A * 8/1994 Hoff ..... F16N 7/18 184/15.3
6,116,454 A * 9/2000 Henderson ..... F15B 1/26 220/563
8,459,413 B2 * 6/2013 Gmirya ..... F16N 17/00 184/6.4
9,410,448 B2 * 8/2016 Sheridan ..... F01M 11/067
9,981,752 B2 * 5/2018 Bergeron ..... B64D 37/14
10,513,949 B2 * 12/2019 Parnin ..... F16H 57/0442
11,073,041 B2 * 7/2021 Uhkoetter ..... F01M 1/02
11,535,219 B2 * 12/2022 Sakakibara ..... F16D 25/12
11,555,418 B2 * 1/2023 Younes ..... F01D 25/20
12,060,974 B1 * 8/2024 Molla ..... F16N 39/06
2006/0054406 A1 * 3/2006 Delaloye ..... F01D 25/18 184/6.11
2010/0065374 A1 * 3/2010 Szolomayer ..... F01M 11/067 700/282
2010/0294597 A1 * 11/2010 Parnin ..... F01D 25/18 184/26
2011/0314830 A1 * 12/2011 Legare ..... F01D 25/20 60/39.08
2013/0319798 A1 * 12/2013 Sheridan ..... F01D 25/20 184/6
2015/0060206 A1 3/2015 Laigle et al.
2020/0116048 A1 4/2020 Bellis
2020/0200043 A1 * 6/2020 Parnin ..... F02C 7/06

FOREIGN PATENT DOCUMENTS

EP 4296491 A1 * 12/2023 ..... F01D 25/18
FR 3105296 A1 6/2021
GB 1339825 A * 7/1971

* cited by examiner

[Fig.1]
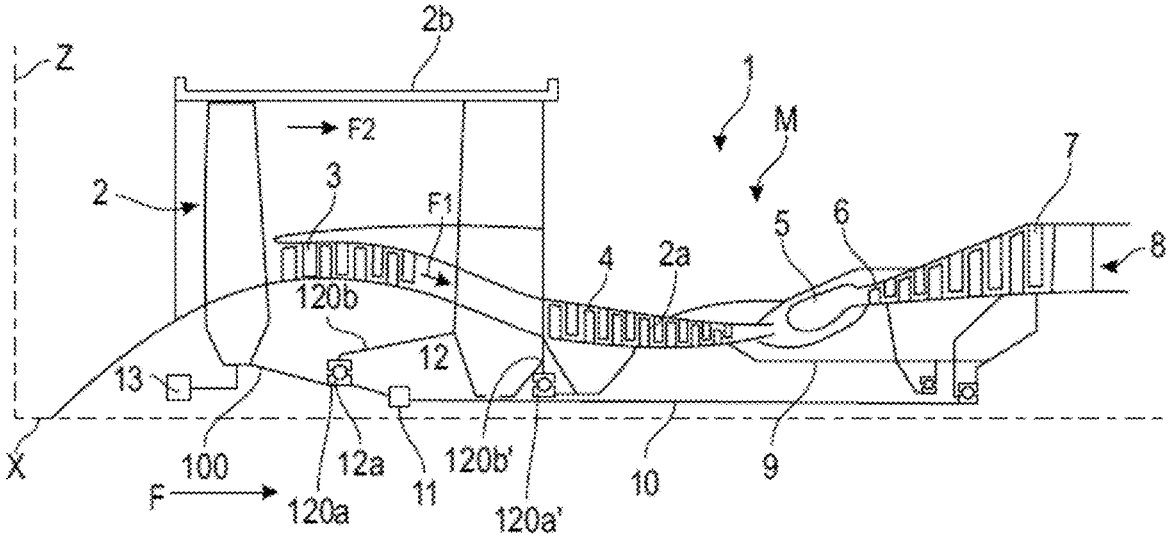

[Fig.2]
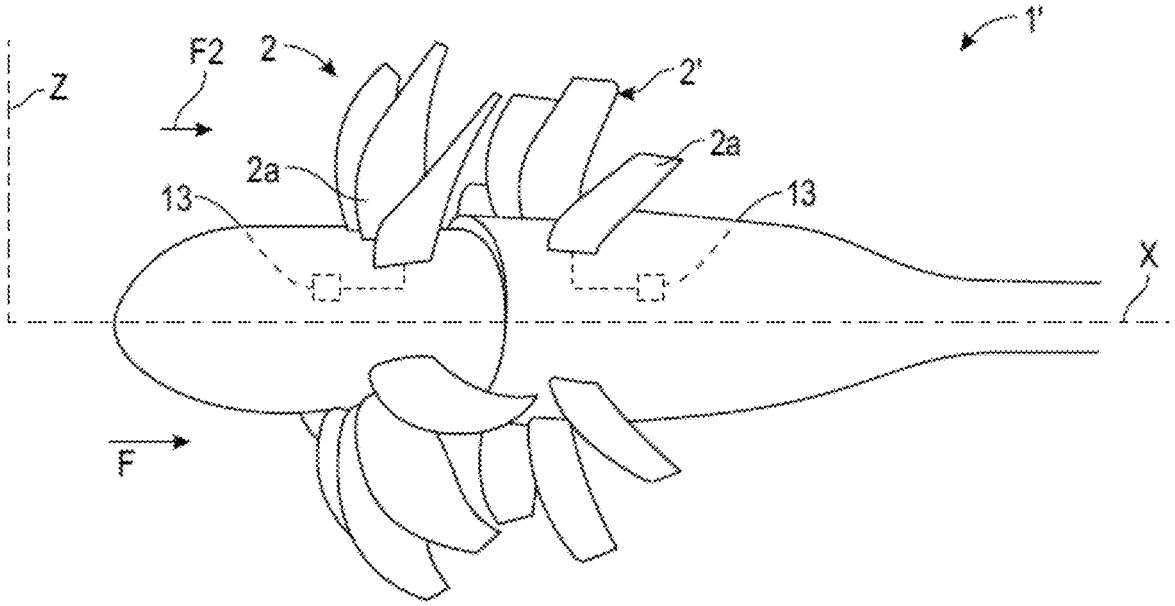

[Fig.3]
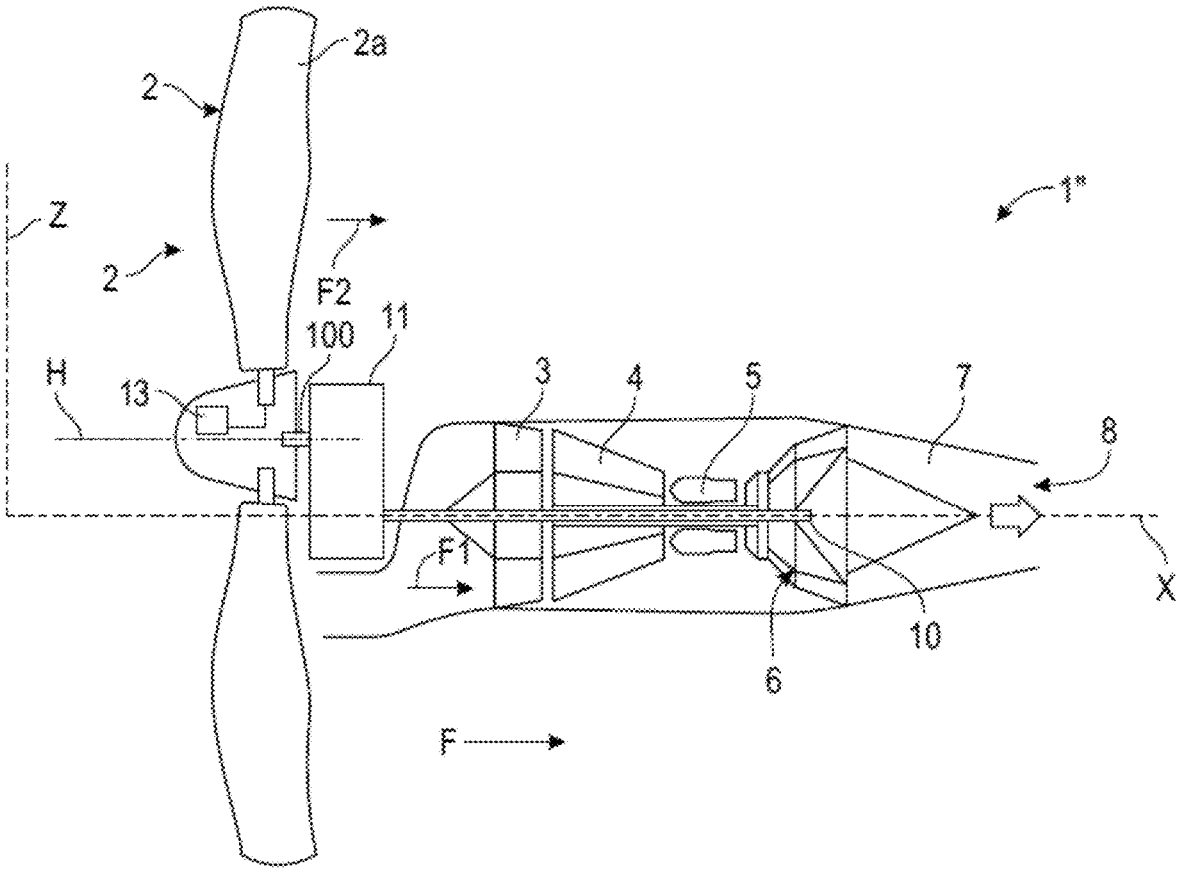

[Fig.4]
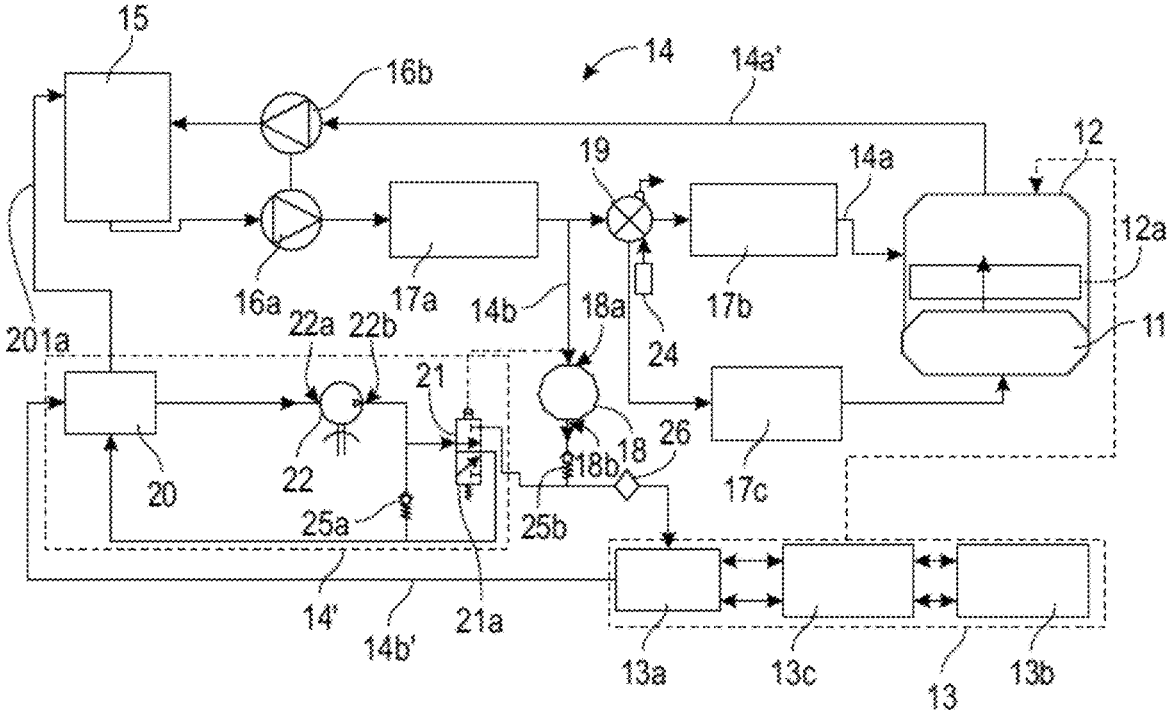

[Fig.5]
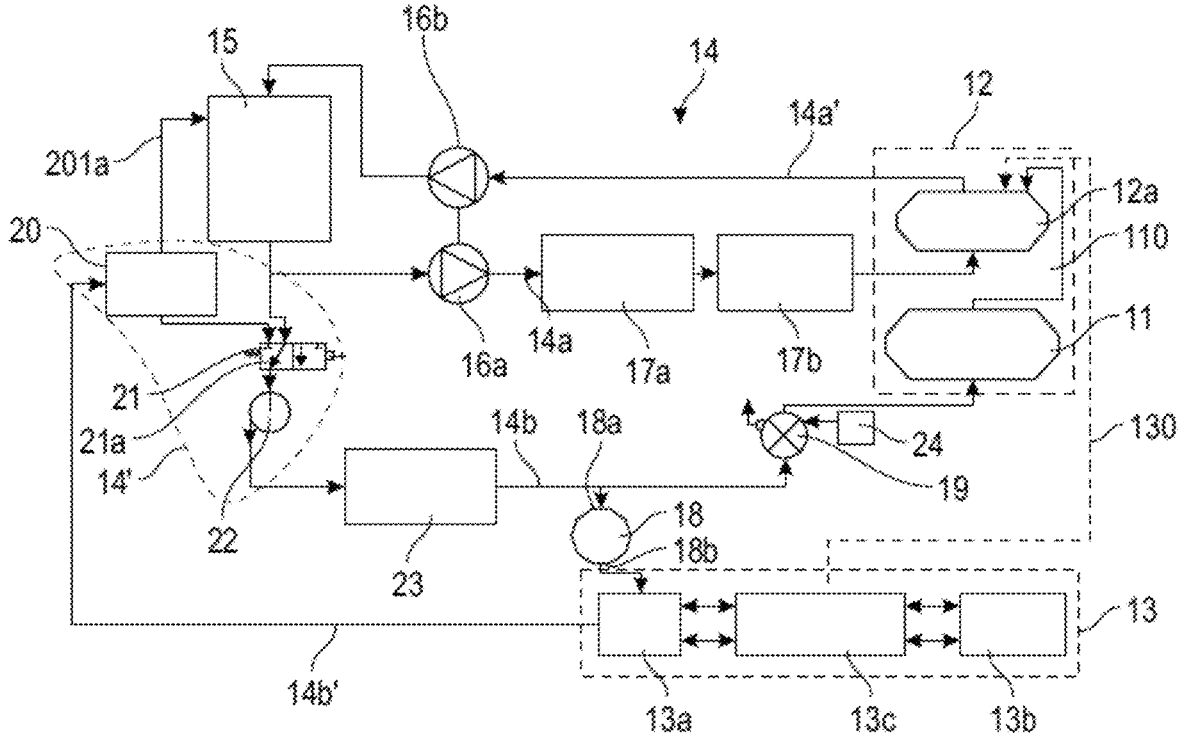

[Fig.6]
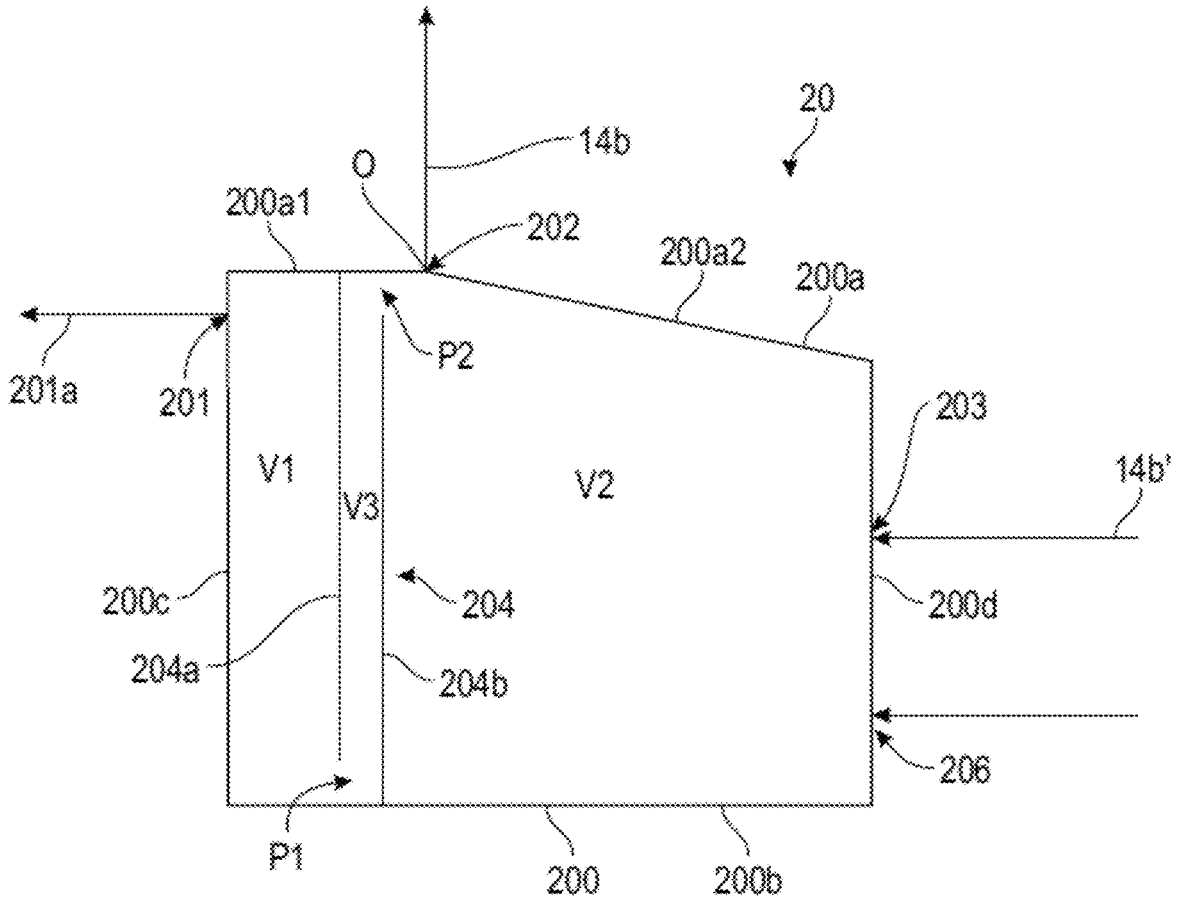

[Fig.7]
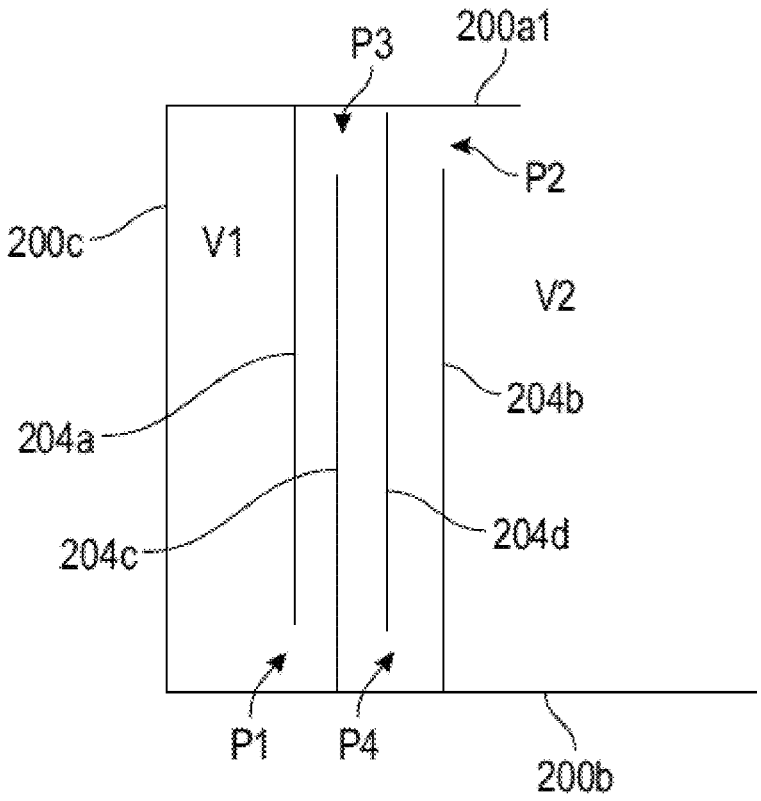

AUXILIARY OIL TANK FOR AN AIRCRAFT TURBINE ENGINE

TECHNICAL FIELD OF THE INVENTION

The invention relates to the field of the oil tanks for the aircraft turbine engines. More specifically, the invention relates to the field of the oil tanks for the phases of flight during which the gravitational force is zero (0 g condition) or negative (negative g condition).

TECHNICAL BACKGROUND

The prior art is illustrated by the documents US-A1-2020116048, FR-A1-3105296 and US-A1-2015060206.

A turbine engine for an aircraft comprises, from upstream to downstream, at least one first rotor, also referred to as a thruster rotor, such as a propeller when the turbine engine is a turboprop engine, or an unducted fan when the turbine engine is of the "open rotor" type, or a ducted fan when the turbine engine is a turbojet engine, a compressor, a combustion chamber and a turbine. The rotor of the compressor is connected to the rotor of the turbine and the first rotor by a drive shaft. An air flow is compressed within the compressor, then the compressed air is mixed with a fuel and burnt within the combustion chamber. The gases formed by the combustion pass through the turbine, which allows to drive the rotor of the compressor and the rotor of the thruster.

The propeller or the fan of the thruster rotor and the rotor of the compressor are equipped with vanes that allow them to exert an action on the air flow. In order to adapt the turbine engine to the flight conditions, it is known to equip the thruster rotor with variable pitch angle vanes or the rotor of the compressor with variable pitch angle vanes. To this end, the turbine engine comprises a control system for controlling the variable pitch angle of the vanes which comprises a control unit connected to a hydraulic actuator to rotate the vanes relative to a longitudinal axis of the vanes according to the orientation of the air flow.

In order to supply oil to the control system and in particular to the hydraulic actuator, as well as to other elements of the turbine engine such as bearings and reducers, the turbine engine typically comprises a main oil supply system. This supply system comprises, for example, a main tank connected to a first supply circuit for lubricating the bearings and to a second supply circuit for supplying oil to the hydraulic actuator. A supply pump is mounted on the second supply circuit, allowing oil to be sucked from the main tank and circulated to the hydraulic actuator. The main tank typically comprises an enclosure with a lower and upper wall joined by transverse walls. The lower wall comprises an aperture connected to the pump for the suction of the oil.

Certain phases of aircraft flight disrupt the oil supply to the hydraulic actuator. In fact, the aircraft can experience phases of flight during which the gravitational force is zero or negative. In the context of the invention, these phases of flight are referred to as the "0 g condition" when the gravitational force is zero, or the "negative g condition" when the gravitational force is reversed. During such phases of flight, the oil contained in the main tank is pressed against the upper wall of the tank opposite the aperture in negative g conditions, or the oil and air form a suspension charged with air bubbles in 0 g conditions. As a result, the pump no longer sucks oil from the tank but air or oil with a high air bubble content, which impairs the oil supply to the control system and can even cause the supply pump to stop. In all cases, the hydraulic actuator of the control system is no longer correctly supplied with oil.

Such a deterioration in the oil supply to the control system, and in particular to the hydraulic actuator, can render the pitch setting of the vanes of the thruster rotor uncontrollable, in particular the blades of the propeller or of the unducted fan, which can lead to the vanes being feathered by a safety system. This significantly reduces the thrust of the turbine engine, leading to a loss of control, which is unacceptable.

Consequently, there is a need to provide an oil tank to supply oil to the control system for controlling the variable pitch angle vanes during the phases of flight when the gravitational force is zero or negative.

SUMMARY OF THE INVENTION

To this end, the invention proposes an auxiliary oil tank for supplying a control system for controlling the pitch of vanes of an aircraft turbine engine, comprising an enclosure comprising:

- a lower wall and an upper wall connected by transverse walls,
- a first outlet port intended to be connected to a main oil tank,
- a second outlet port intended to be connected to the control system via a second oil supply circuit,
- a first inlet port intended to be connected to the control system via an auxiliary recovery circuit.

The enclosure is characterised in that it further comprises:

- a first internal volume in fluid communication with the first outlet port,
- a second internal volume in fluid communication with the second outlet port, and separated from the first internal volume by a baffle, the baffle comprising a first end wall extending from the upper wall towards the lower wall and a second end wall extending from the lower wall towards the upper wall, the first and second end walls being substantially parallel, the first end wall and the lower wall defining a first fluid passage, and the second end wall and the upper wall defining a second fluid passage.

The tank according to the invention therefore comprises a baffle which allows to separate the first internal volume from the second internal volume. When the aircraft experiences a phase of flight during which the gravitational force is zero or negative, the air entering through the first outlet port circulates through the enclosure from the first internal volume towards the second internal volume. According to the invention, the circulation of air between the two volumes is slowed by the baffle, which allows the oil contained in the second internal volume to remain in communication with the second outlet port to supply the second circuit. This prevents the air from reaching the second outlet port. Thanks to the invention, the auxiliary tank is able to supply the control system during such a flight phase. The vanes are therefore not feathered and the aircraft turbine engine maintains a maximum thrust during this phase of flight.

The invention may comprise one or more of the following characteristics, taken alone or in combination with each other:

- the first end wall and the second end wall delimit an intermediate volume, the sum of the first volume and of the intermediate volume being equal to the second internal volume;

the first end wall and the second end wall define an intermediate volume, the sum of the first volume and of the intermediate volume being less than the second internal volume;

the baffle comprises a first intermediate wall and a second intermediate wall which are arranged substantially parallel to and between the first and second end walls, the first intermediate wall defining with the upper wall a third fluid passage and the second intermediate wall defining with the lower wall a fourth fluid passage, the first intermediate wall being arranged between the first end wall and the second intermediate wall;

the upper wall of the enclosure comprises a first segment substantially parallel to the lower wall and a second segment inclined towards the inside of the enclosure, the first and second segments forming a top directed towards the outside of the enclosure;

the first internal volume is between 1 L and 50 L and the second internal volume is between 1 L and 50 L;

the enclosure further comprises a second inlet port intended to be connected to a valve.

The invention also relates to a turbine engine for an aircraft comprising:

variable pitch angle vanes, a control system for controlling the vanes comprising a control unit connected to at least one hydraulic actuator, an oil supply system comprising:

a main supply system comprising:

a second supply circuit for supplying the control system, a main tank connected to the second supply circuit, and an oil supply pump mounted on the second supply circuit and comprising an inlet and an outlet connected to the control system, an auxiliary supply device comprising:

an auxiliary oil tank according to any of the preceding characteristics, the first outlet port being connected to the main tank, the second outlet port being connected to the second supply circuit and the first inlet port being connected to the control system.

The turbine engine may comprise one or more of the following characteristics, taken singly or in combination:

the auxiliary supply device further comprises a valve comprising a body having a first inlet connected to the main tank, a second inlet connected to the second outlet port of the auxiliary tank and an outlet connected to the inlet of the supply pump, the valve further comprising a member movable within the body and configured to move between a first position in which the first inlet of the valve is in fluid communication with the outlet of the valve and a second position in which the second inlet of the valve is in fluid communication with the outlet of the valve;

the auxiliary tank comprises a second inlet port, and the auxiliary supply device comprises a valve comprising a body having an inlet connected to the auxiliary tank and a first outlet connected to the second inlet port of the auxiliary tank, and a second outlet connected to the control system, the valve further comprising a member movable within the body and configured to move between a first position in which the inlet of the valve is in fluid communication with the first outlet of the valve and a second position in which the inlet of the valve is in fluid communication with the second outlet of the valve;

the inlet of the supply pump is connected to the main tank.

BRIEF DESCRIPTION OF THE FIGURES

Further characteristics and advantages will be apparent from the following description of a non-limiting embodiment of the invention with reference to the appended drawings in which:

FIG. 1 is a schematic representation in longitudinal cross-section of an aircraft half-turbine engine according to a first embodiment of the invention;

FIG. 2 is a schematic perspective representation of an aircraft turbine engine according to a second embodiment of the invention;

FIG. 3 is a schematic representation in longitudinal cross-section of an aircraft turbine engine according to a third embodiment of the invention;

FIG. 4 is a schematic representation of an oil supply system according to a first embodiment of the invention;

FIG. 5 is a schematic representation of an oil supply system according to a second embodiment of the invention;

FIG. 6 is a schematic cross-sectional representation of an auxiliary oil tank according to the invention;

FIG. 7 is a partial schematic cross-sectional representation of the auxiliary oil tank according to one example embodiment of the invention;

DETAILED DESCRIPTION OF THE INVENTION

A turbine engine 1, 1', 1" for an aircraft is shown, for example, in FIGS. 1 to 3. The turbine engine 1, 1, 1" comprises a first rotor 2 connected to an engine M extending around a longitudinal axis X. The engine M comprises, from upstream to downstream in the direction of flow of a main air flow F along the longitudinal axis X, a compressor such as a low-pressure compressor 3 and a high-pressure compressor 4, a combustion chamber 5, a turbine such as a high-pressure turbine 6 and a low-pressure turbine 7, and a nozzle 8.

The rotor of the high-pressure turbine 6 is connected to the rotor of the high-pressure compressor 4 by a high-pressure shaft 9. The rotor of the low-pressure turbine 7 is connected to the rotor of the low-pressure compressor 3 by a low-pressure shaft 10.

The low-pressure 10 and high-pressure 9 shafts are supported by bearings 12*a*. The bearings 12*a* are contained in a lubrication enclosure 12 for their lubrication. For example, an upstream bearing 120*a* is arranged radially between an upstream end of the low-pressure shaft 10 and an upstream bearing support 120*b* and a downstream bearing 120*a'* is arranged downstream of the upstream bearing 120*a* and radially between the low-pressure shaft 10 and a downstream bearing support 120*b'*. The lubrication enclosure 12 is annular. The upstream and downstream bearings 120*a*, 120*a'* are arranged in the lubrication enclosure 12.

The first rotor 2 is driven in rotation by a rotor shaft 100. The rotor shaft 100 is connected to the low-pressure shaft 10. The low-pressure shaft 10 drives in rotation the rotor shaft 100. Advantageously, the low-pressure shaft 10 is connected to the rotor shaft 100 by a speed reducer 11. This allows the first rotor 2 to be driven at a lower speed than the speed of rotation of the low-pressure shaft 10. The speed reducer 11 is for example arranged in the lubrication enclosure 12 between the upstream bearing 120*a* and the downstream bearing 120*a'*.

The main air flow F passes through the turbine engine 1, 1', 1" and divides into a primary air flow F1 which passes through the engine M in a primary duct and a secondary air flow F2 which passes through the first rotor 2 in a secondary duct surrounding the primary duct.

The turbine engine 1, 1', 1" comprises vanes 2*a* that allow to exert an action on the main air flow F or primary air flow F1 or the secondary air flow F2. For example, the rotors of the low-pressure 3 and high-pressure 4 compressors comprise vanes 2*a* which allow to compress the primary air flow F1 upstream of the combustion chamber 5.

In general, the vanes 2*a* can be stationary in rotation about the longitudinal axis X, or can be movable in rotation about the longitudinal axis X or an axis parallel to the longitudinal axis X.

In a first embodiment shown in FIG. 1, the turbine engine 1 is a double flow turbojet engine. In this embodiment, the first rotor 2 is a ducted fan arranged upstream of the engine M. The fan comprises vanes 2*a*. The vanes 2*a* of the fan are movable in rotation about the longitudinal axis X. They are carried, for example, by a disc centered on the longitudinal axis X. The vanes 2*a* are arranged inside a fan casing 2*b*. The casing 2*b* is surrounded by a nacelle (not shown).

In a second embodiment shown in FIG. 2, the turbine engine 1' is a turbojet engine with an unducted fan. In this embodiment, the first rotor 2 is an unducted fan comprising vanes 2*a*. According to this embodiment, the fan is arranged downstream of the engine M (not visible in this figure). The fan is movable in rotation about the longitudinal axis X. The vanes 2*a* of the fan are carried by a disc movable in rotation about the longitudinal axis X. In addition, according to this embodiment, a stator vane 2' is optionally arranged downstream of the fan 2 in order to straighten the secondary air flow F2. The stator vane 2' forms a stationary vane ring about the longitudinal axis X. It comprises vanes 2*a*, which may have variable pitch. The vanes 2*a* are mounted on the outside of the nacelle.

In a third embodiment shown in FIG. 3, the turbine engine 1" is a turboprop engine. In this embodiment, the first rotor 2 is a propeller arranged upstream of the engine M. The propeller is movable in rotation about a propeller axis H parallel to the longitudinal axis X and comprises vanes 2*a*. The vanes 2*a* are carried by a disc centered on the propeller axis H. The vanes 2*a* are, for example, at least two in number and evenly distributed over the disc.

The vanes 2*a* extend radially with respect to the longitudinal axis X. They typically comprise a blade and an element for attachment to the disc. The attachment element is, for example, a root or a platform. According to the invention, the vanes 2*a* have a variable pitch angle. By variable pitch angle, it is understood that the vanes 2*a* are movable in rotation about a transverse axis Z substantially perpendicular or perpendicular to the longitudinal axis X.

In order to control the pitch angle of the vanes 2*a*, the turbine engine 1, 1, 1" according to the invention comprises a system 13 for controlling the variable pitch angle vanes 2*a*. The control system 13 comprises a control unit 13*a* and at least one hydraulic actuator 13*b* supplied with oil. The control unit 13*a* is, for example, stationary in rotation about the longitudinal axis X. The control unit 13*a* is connected, for example, to a stator of the turbine engine 1, 1, 1". The control unit 13*a* is known in the field of the invention by the acronym PCU for "Pitch Control Unit". The hydraulic actuator 13*b* is, for example, a hydraulic cylinder comprising a rod that is movable in translation and is connected to the vane 2*a*, possibly via a mechanism for transforming the movement. The translational movement of the rod allows the vane 2*a* to rotate around its axis. The translational movement of the movable rod is controlled by the control unit 13*a*, which supplies oil to the hydraulic actuator 13*b*. The hydraulic actuator 13*b* is movable in rotation about the longitudinal axis X or about an axis parallel to the longitudinal axis X. The hydraulic actuator 13*b* is, for example, secured in rotation to the vanes 2*a*. The hydraulic actuator 13*b*, for example, is arranged upstream of the control unit 13*a*.

Advantageously, the control system 13 comprises a device for transferring oil 13*c* from the control unit 13*a* towards the hydraulic actuator 13*b*. The oil transfer device 13*c* transfers oil from the control unit 13*a* which is stationary towards the hydraulic actuator 13*b* which is movable in rotation. The oil transfer device 13*c* is known by the acronym OTB for "Oil Transfer Bearing". The oil transfer device 13*c* is located in the lubrication enclosure 12, for example.

The turbine engine 1, 1', 1" also comprises an electrical control unit 24. The electrical control unit 24 is used to drive the control unit 13*a*. The electrical control unit 24 is, for example, a FADEC (Full Authority Digital Engine Control).

In addition, the turbine engine 1, 1', 1" comprises an oil supply system comprising a main supply system 14 and an auxiliary supply device 14', shown in FIGS. 4 and 5.

The main supply system 14 lubricates the bearings 12*a* within the lubrication enclosure 12 and the reducer 11 and supplies oil to the control system 13 during a first operating phase of the turbine engine 1, 1', 1". The auxiliary supply device 14' ensures the lubrication of the control system 13 during a second operating phase of the turbine engine 1, 1', 1" during which the gravitational force is zero (0 g condition) or reversed (negative g condition).

The main oil supply system 14 comprises a first oil supply circuit 14*a* for supplying the lubrication enclosure 12 and a second oil supply circuit 14*b* for supplying the control system 13. The main supply system 14 advantageously comprises a variable diaphragm metering valve 19. The metering valve 19 allows to supply oil to the speed reducer 11. In a first embodiment, this metering valve 19 may have the function of a valve for distributing the oil distributed between the lubrication enclosure 12 and the speed reducer 11.

The main supply system 14 advantageously comprises an oil recovery circuit 14*a'* from the lubrication enclosure 12 and an oil recovery circuit 14*b'* from the control system 13.

The main supply system 14 also comprises a main oil tank 15 connected to the first supply circuit 14*a* and the second supply circuit 14*b*.

The oil sent to the bearings 12*a*, for example the upstream bearing 120*a* and the downstream bearing 120*a'*, to the reducer 11 and the oil leaks from the transfer device 13*c*, fall back to the bottom of the lubrication enclosure 12. To optimise oil consumption, this oil is recovered and directed, for example, into the oil recovery circuit 14*a'* of the lubrication enclosure 12.

The first supply circuit 14*a* comprises a first supply pump 16*a* allowing to suck oil from the main tank and its circulation through the first supply circuit 14*a* to supply oil to the lubrication enclosure 12. Advantageously, the first supply circuit 14*a* comprises a main exchanger 17*a*, for example air/oil or oil/fuel, and optionally a second exchanger 17*b*, for example oil/fuel, which are arranged between the first pump 16*a* and the lubrication enclosure 12.

The circuit 14*a'* for recovering oil from the lubrication enclosure 12 comprises a second recovery pump 16*b* connected to the lubrication enclosure 12 and to the main tank 15. The pump 16*b* allows to recover the oil from the lubrication enclosure 12 and returns it to the main tank 15 via the recovery circuit 14*a'*.

In addition, the main supply system 14 comprises a supply pump 18 dedicated to supplying oil to the control system 13. The supply pump 18, for example, is mounted on the second supply circuit 14*b*. The supply pump 18 is a positive displacement pump, for example. The positive displacement pump may have a stationary or variable displacement. The supply pump 18 comprises an inlet 18*a* and an outlet 18*b* connected to the control system 13.

The second supply circuit 14*b* may comprise a filter 26 arranged between the supply pump 18 and the control system 13.

During the first operating phase of the turbine engine 1, 1', 1", the first pump 16*a* sucks oil from the main tank 15 and allows the oil to circulate through the first supply circuit 14*a* to the lubrication enclosure 12. The supply pump 18 also sucks oil from the main tank 15, for example upstream or downstream of the first pump 16*a*, and conveys the oil through the second supply circuit 14*b* to the control system 13.

During the second phase of operation, typically a flight in negative (or inverted) gravity, the oil is pressed into the upper portion of the main tank 15 while the lower portion connected to the first pump 16*a* is occupied by air. In zero gravity, an air-oil mixture is suspended in the tank 15 and in reverse gravity, air occupies the lower portion of the main tank 15 connected to the first pump 16*a*. The supply pump 18 is indirectly connected to the lower portion of the main tank 15, and therefore runs the risk of sucking air from the main tank 15, or oil with a high air bubble content. This is not acceptable because the control system 13 must be supplied with oil that is relatively free of air bubbles, so as not to compromise the operation of the control unit 13*a* and therefore the hydraulic actuator 13*b* that controls the pitch of the vanes 2*a*. The presence of air can also cause the supply pump 18 to stop. Consequently, in order to ensure a suitable oil supply for the control system 13 during the second phase of operation of the turbine engine 1, 1', 1", the invention proposes an auxiliary supply device 14'. The auxiliary supply device 14' is mounted on the second supply circuit 14*b*.

The auxiliary supply device 14' comprises an auxiliary oil tank 20, optionally an auxiliary pump 22 and a valve 21. The auxiliary pump 22 comprises an inlet 22*a* and an outlet 22*b*. The valve 21 is, for example, a 3/2 hydraulic directional control valve, i.e. it has three apertures and two positions.

In a first embodiment shown in FIG. 4, the auxiliary pump 22 is arranged between the valve 21 and the auxiliary tank 20. The inlet 22*a* of the pump 22 is connected to the auxiliary tank 20. The auxiliary pump 22 is a fixed-displacement hydraulic pump. The auxiliary supply device 14' advantageously comprises a rotary motor for driving the auxiliary pump 22. Alternatively, the auxiliary pump 22 is driven by the low-pressure shaft 10 or the high-pressure shaft 9.

In this embodiment, the valve 21 is a spring-return hydraulically-operated directional control valve. The valve 21 has a body 21*a* with an inlet connected to the outlet 22*b* of the auxiliary pump 22 and a first outlet connected to the auxiliary tank 20 and a second outlet connected to the second supply circuit 14*b*, between the supply pump 18 and the control system 13. The valve 21 further comprises a movable member in the body 21*a* configured to move between a first position in which the inlet of valve 21 is in fluid communication with the first outlet of the valve 21 and a second position in which the inlet of the valve 21 is in fluid communication with the second outlet of the valve 21. The valve 21 comprises, for example, a return spring for returning the movable member from the second position towards the first position.

In the first position, as shown in FIG. 4, the auxiliary pump 22 sucks oil from the auxiliary tank 20 and the oil is returned to the auxiliary tank 20. The control system 13 is supplied with oil by the supply pump 18, which sucks oil from the main tank 15.

In the second position (not shown), the auxiliary pump 20 sucks oil from the auxiliary tank 20 and the oil is conveyed to the control system 13 via the second supply circuit 14*b*, for example. Thus, when the turbine engine 1, 1', 1" is in the first operating phase, in particular when the aircraft is in a "normal" flight phase, the valve 21 is in the first position. When the turbine engine 1, 1', 1" is in the second operating phase, in particular when the aircraft is in a flight phase in which the gravitational force is zero (called "0 g") or negative (called "negative g"), the valve 21 is in the second position. This allows to ensure that the control system 13 is supplied with oil from the auxiliary tank 20 and avoids any interruption in the oil supply to the control system 13. The auxiliary pump 22 is therefore active both when the movable member of the valve 21 is in the first position and in the second position. This allows to eliminate the need for a priming time for the auxiliary pump 22 and ensures a rapid oil supply to the control system 13 during the second operating phase of the turbine engine 1, 1', 1".

The valve 21 comprises a hydraulic actuation chamber connected to the inlet 18*a* of the supply pump 18. When the turbine engine 1, 1', 1" is in the second operating phase (negative or zero gravity), the pressure in the first supply circuit 14*a* drops as the first pump 16*a* sucks in air or an air-oil mixture from the main tank 15. The pressure at the inlet 18*a* of the supply pump 18 connected to the first supply circuit 14*a* then falls below a threshold pressure, which causes the movable member of the valve 21 to move into the second position under the action of the spring of the valve. This configuration allows to simplify the control of the valve 21. This does not require a special sensor, since it is activated by the sharp drop in pressure at the inlet 18*a* of the supply pump 18.

Alternatively, the valve 21 is directly sensitive to the gravitational force.

Furthermore, according to this first embodiment, advantageously, the auxiliary supply device 14' also comprises a pressure limiter 25*a* arranged at the outlet of the auxiliary pump 22, between the auxiliary pump 22 and the valve 21. The pressure limiter 25*a* is, for example, a non-return valve.

According to this first embodiment, the metering valve 19 is mounted on the first supply circuit 14*a*. The metering valve 19 is mounted between the first pump 16*a* and the lubrication enclosure 12. Preferably, the metering valve 19 is mounted between the main exchanger 17*a*, which in this mode is an oil/fuel exchanger, and the second exchanger 17*b*. In this first embodiment, the metering valve 19 acts as a valve for distributing the oil distributed between the lubrication enclosure 12 and the speed reducer 11. This is a valve with two outlets. The first outlet of the metering valve 19 is connected to the lubrication enclosure 12 and the second outlet of the metering valve 19 is connected to the reducer 11. The metering valve 19, for example, is controlled by the electrical control unit 24.

In addition, according to this example, a third exchanger 17*c*, for example air/oil, connects the second outlet of the metering valve 19 and the reducer 11.

In a preferred embodiment of the invention, the supply pump 18 comprises a non-return valve 25*b* to ensure that all the oil delivered by the auxiliary pump 22 supplies the control system 13.

In a second embodiment shown in FIG. 5, the valve 21 has a body 21*a* with a first inlet connected to the main tank 15 and a second inlet connected to the auxiliary tank 20. The valve 21 also has an outlet connected to the inlet 18*a* of the supply pump 18. The valve 21 further comprises a movable member in the body configured to move between a first position in which the first inlet is in fluid communication with the outlet and a second position in which the second inlet is in fluid communication with the outlet. The valve 21 comprises, for example, a return spring allowing the returning of the movable member from the second position towards the first position. The outlet 18*b* of the supply pump 18 is connected to the control circuit 13.

It is thus understood that in the first position, the supply pump 18 sucks oil from the main tank 15 and in the second position, the supply pump 18 sucks oil from the auxiliary tank 20. The valve 21 thus allows to control the flow of oil in the second circuit 14*b*. When the turbine engine 1, 1, 1" is in a first operating phase, in particular when the aircraft is in a "normal" flight phase, the valve 21 is in the first position and the main pump 18 sucks oil from the main tank 15 to supply the control system 13. When the turbine engine 1, 1, 1" is in a second operating phase, in particular when the aircraft is in a flight phase in which the gravitational force is zero (referred as the 0 g condition) or negative (referred as the negative g condition), the valve 21 is in the second position and the main pump 18 sucks oil from the auxiliary tank 20 to supply the control system 13 with oil.

In a first example of embodiment, the valve 21 is electrically controlled. According to this example, the turbine engine 1, 1, 1" comprises a sensor configured to deliver a signal to the electrical control unit 24. The sensor is configured to detect the second operating phase of the turbine engine 1, 1, 1". The sensor is an accelerometer, for example.

According to a second example of embodiment, the movable member of the valve 21 is directly sensitive to the gravitational force exerted on the turbine engine 1, 1, 1". When the gravitational force is greater than a given threshold, i.e. in the first operating state, the movable member is in the first position. In the second operating state, the movable member detects the second operating state and moves to the second position.

The auxiliary pump 22 in this second embodiment is optional. The auxiliary pump 22 is, for example, a centrifugal pump connected to the outlet of the valve 21. The auxiliary pump 22 is therefore arranged between the valve 21 and the supply pump 18. The pump inlet 18*a* is therefore connected to the valve outlet 21 via the auxiliary pump 22. Optionally, a second air/oil exchanger 23 is arranged between the valve 21 and the supply pump 18. More specifically, the second air/oil exchanger 23 is arranged between the centrifugal pump 22 and the supply pump 18. The centrifugal pump 22 and the second air/oil exchanger 23 are mounted on the second supply circuit 14*b*.

In this embodiment, the metering valve 19 is mounted on the second supply circuit 14*b*. The metering valve 19 is mounted between the supply pump 18 and the reducer 11, and comprises a single outlet connected to the lubrication enclosure 12. In this embodiment, the metering valve 19 has no function of distributing the flow rate between two outlets. The supply pump 18 is connected in bypass on the second circuit 14*b* between the valve 21, and in particular the second air/oil exchanger 23 when present, and the metering valve 19.

Advantageously, the metering valve 19 is able to open when the valve 21 is in the first position, allowing oil to be supplied to the reducer 11 from the main tank 15, and is able to remain open and/or close when the valve 21 is in the second position. Preferably, the metering valve 19 is able to close when the valve 21 is in the second position. This means that oil is not supplied to the reducer 11 from the auxiliary tank 20, but only the control system 13 is supplied from the auxiliary tank 20. In this way, the auxiliary tank 20 is sized to supply only the control system 13, making it less bulky.

Advantageously, the variable opening of the metering valve 19 is controlled by the electrical control unit 24. The electrical control unit 24 sends a signal to the metering valve 19 to open or close the latter depending on the operating phase.

The auxiliary tank 20 according to the invention is shown in FIG. 6, for example. The auxiliary tank 20 is configured to deliver oil during the second operating phase of the turbine engine 1, 1, 1".

The auxiliary tank 20 comprises an enclosure 200. The enclosure 200 is made of metal, for example. The enclosure 200 is polygonal, for example. It comprises an upper wall 200*a* and a lower wall 200*b* connected by opposing transverse walls 200*c*, 200*d*. The transverse walls 200*c*, 200*d* may be parallel to each other. The upper wall 200*a* comprises, for example, a first segment 200*a*1 parallel to the lower wall 200*b* and a second segment 200*a*2 inclined towards the interior of the enclosure 200. The first segment 200*a*1 and the second segment 200*a*2 meet at a top O facing outwards from the enclosure 200. This configuration allows to optimise the flow of oil in the second supply circuit 14*b* during the second operating phase of the turbine engine 1, 1', 1". The top O represents a high point for the oil recovery, which normally eliminates the risk of air being present at this level in a negative gravity situation.

The enclosure 200 has a first outlet port 201 connected to the main tank 15 for example by a first pipe 201*a*, a second outlet port 202 connected to the second supply circuit 14*b* by the valve 21 or the auxiliary pump 22, an inlet port 203 connected to the control system by the oil recovery circuit 14*b*' of the control system 13 and optionally a second inlet port 206 connected to the valve 21. The first outlet port 201 is formed, for example, on the transverse wall 200*c* and the first inlet port 203 is formed, for example, on the opposite transverse wall 200*d*. The second outlet port 202 is located on the upper wall 200*a*, for example on the top O.

The enclosure 200 has a total volume of, for example, between 2 L and 100 L, advantageously between 2 L and 40 L and preferably between 4 L and 30 L. The enclosure 200 comprises a first internal volume V1 in fluid communication with the first outlet port 201 and a second internal volume V2 in fluid communication with the second outlet port 202. The first internal volume V1 is between 1 L and 50 L, advantageously between 1 L and 20 L and even more advantageously between 2 L and 15 L. The second internal volume V2 is between 1 L and 50 L, advantageously between 1 L and 20 L and even more advantageously between 2 L and 15 L. Preferably, the first internal volume V1 is smaller than the second internal volume V2.

The auxiliary tank 20 also comprises a baffle 204 arranged in the enclosure 200 which separates the first internal volume V1 from the second internal volume V1. The baffle 204 comprises a first end wall 204*a* extending from the upper wall 200*a* towards the lower wall 200*b* and a second end wall 204*b* extending from the lower wall 200*b* towards the upper wall 200*a*. The first and second end walls 204*a*, 204*b* are for example parallel to the transverse walls 200*c*, 200*d*. The first and second end walls 204*a*, 204*b* are arranged between the first outlet port 201 and the second outlet port 202. The first end wall 204*a* and the lower wall 200*b* delimit a first fluid passage P1, and the second end wall 204*b* and the upper wall 200*a* delimit a second fluid passage P2. The fluid is, for example, air and/or oil.

The first end wall 204*a* and the second end wall 204*b* define an intermediate volume V3. In a first example, the sum of the first volume V1 and of the intermediate volume V3 is equal to the second internal volume V2. This allows to ensure that the internal volume V2 will contain only oil during the second phase of operation.

According to another example of embodiment, the sum of the volume of the pipe 201*a* connecting the first inlet port 201 to the main tank 15, the first volume V1 and the intermediate volume V3 is equal to the second internal volume V2. In this example, the sum of the first volume V1 and of the intermediate volume V3 is therefore less than the second internal volume V2. In addition, the volume of the pipe 201*a* can be dimensioned to be equal to the volume of oil consumed during the second phase of operation of the turbine engine 1, 1, 1".

As illustrated in FIG. 7, advantageously, the baffle 204 further comprises a first intermediate wall 204*c* and a second intermediate wall 204*d* which are arranged parallel to and between the first and second end walls 204*a*, 204*b*, the first intermediate wall 204*c* delimiting with the upper wall 200*a* a third fluid passage P3 and the second intermediate wall 204*d* delimiting with the lower wall 200*b* a fourth fluid passage P4, the first intermediate wall 204*c* being arranged between the first end wall 204*a* and the second intermediate wall 204*d*.

During the first phase of operation of the turbine engine 1, 1, 1", the auxiliary tank 20 is supplied with oil by the control system 13. The excess oil is transferred to the main tank 15. This transfer is provided by the pipe 201*a*. The control system 13 is supplied with oil from the main tank 15.

During the second operating phase of the turbine engine 1, 1, 1", air enters the auxiliary tank 20 via the first outlet port 201. This is because the flow of oil exiting the tank is less than the flow entering it. However, thanks to the baffle 204, the passage of air from the first internal volume V1 towards the second internal volume V2 is slowed down. In this way, the supply pump 18 or the auxiliary pump 22 sucks in oil and not air or oil with a high air content, which allows to supply the control system 13 during the second operating phase. It is understood that, advantageously, the volume of the pipe 201*a* and of the baffle 204*a* is equal to the volume of oil leaving the second outlet aperture 202 during the second operating phase.

An auxiliary tank 20 of this type has the advantage of being simple and reliable. For example, such an auxiliary tank 20 does not implement any movable parts to manage the air intake from the main tank 15. For example, the first outlet port 201 can remain open and no closing member is implemented. The baffle 204 is also stationary, which is easily conceivable and allows to improve the reliability compared with a movable part such as a piston.

The invention claimed is:

1. An auxiliary oil tank for supplying a control system for controlling the pitch of vanes of an aircraft turbine engine, comprising an enclosure comprising:

a lower wall and an upper wall connected by transverse walls, a first outlet port intended to be connected to a main oil tank, a second outlet port intended to be connected to the control system via a second oil supply circuit, a first inlet port intended to be connected to the control system via an auxiliary recovery circuit, wherein the enclosure further comprises:

a first internal volume (V1) in fluid communication with the first outlet port, a second internal volume (V2) in fluid communication with the second outlet port, and separated from the first internal volume (V1) by a baffle, the baffle comprising a first end wall extending from the upper wall towards the lower wall and a second end wall extending from the lower wall towards the upper wall, the first and second end walls being parallel, the first end wall and the lower wall defining a first fluid passage (P1), and the second end wall and the upper wall defining a second fluid passage (P2).

2. The tank according to claim 1, wherein the first end wall and the second end wall delimit an intermediate volume (V3), the sum of the first volume (V1) and of the intermediate volume (V3) being equal to the second internal volume (V2).

3. The tank according to claim 1, wherein the first end wall and the second end wall define an intermediate volume (V3), the sum of the first volume (V1) and of the intermediate volume (V3) being less than the second internal volume (V2).

4. The tank according to claim 1, wherein the baffle comprises a first intermediate wall and a second intermediate wall which are arranged parallel to and between the first and second end walls, the first intermediate wall delimiting with the upper wall a third fluid passage and the second intermediate wall delimiting with the lower wall a fourth fluid passage (P4), the first intermediate wall being arranged between the first end wall and the second intermediate wall.

5. The tank according to claim 1, wherein the upper wall of the enclosure comprises a first segment parallel to the lower wall and a second segment inclined towards the inside of the enclosure, the first and second segments forming a top (O) directed towards the outside of the enclosure.

6. The tank according to claim 1, wherein the first internal volume (V1) is between 1 L and 50 L and the second internal volume (V2) is between 1 L and 50 L.

7. The tank according to claim 1, wherein the enclosure further comprises a second inlet port intended to be connected to a valve.

8. A turbine engine for an aircraft comprising:

variable pitch angle vanes, a control system for controlling the pitch of the vanes comprising a control unit connected to at least one hydraulic actuator, an oil supply system comprising:

a main supply system comprising:

a second supply circuit for supplying the control system, a main tank connected to the second supply circuit, and an oil supply pump mounted on the second supply circuit and comprising an inlet and an outlet connected to the control system, an auxiliary supply device comprising:

an auxiliary oil tank according to any of the preceding claims, the first outlet port being connected to the main tank, the second outlet port being connected to the second supply circuit and the first inlet port being connected to the control system.

9. The turbine engine according to claim 8, wherein the auxiliary supply device further comprises a valve comprising a body having a first inlet connected to the main tank, a second inlet connected to the second outlet port of the auxiliary tank and an outlet connected to the inlet of the supply pump, the valve further comprising a member movable within the body and configured to move between a first position in which the first inlet of the valve is in fluid communication with the outlet of the valve and a second position in which the second inlet of the valve is in fluid communication with the outlet of the valve.

10. The turbine engine according to claim 8, wherein the auxiliary tank comprises a second inlet port, and in that the auxiliary supply device comprises a valve comprising a body having an inlet connected to the auxiliary tank and a first outlet connected to the second inlet port of the auxiliary tank, and a second outlet connected to the control system, the valve further comprising a member movable within the body and configured to move between a first position in which the inlet of the valve is in fluid communication with the first outlet of the valve and a second position in which the inlet of the valve is in fluid communication with the second outlet of the valve.

11. The turbine engine according to claim 10, wherein the inlet of the supply pump is connected to the main tank.

* * * * *